United States Patent [19]

Elineau

[11] 4,301,720

[45] Nov. 24, 1981

[54] MACHINE FOR TYING COILS OF METAL WIRE

[75] Inventor: Hubert Elineau, Versailles, France

[73] Assignee: Arbed Societe Anonyme, Luxembourg, Luxembourg

[21] Appl. No.: 120,081

[22] Filed: Feb. 7, 1980

[30] Foreign Application Priority Data

Feb. 22, 1979 [LU] Luxembourg ..... 4535

[51] Int. Cl.[3] ..... B65B 13/28

[52] U.S. Cl. ..... 100/12; 100/3; 100/14; 100/27; 100/31; 100/264

[58] Field of Search ..... 100/3, 31, 12, 264, 100/27, 14, 28

[56] References Cited

U.S. PATENT DOCUMENTS

| | | | |
|---|---|---|---|
| 2,930,313 | 3/1960 | Bocher | 100/14 |
| 3,352,228 | 11/1967 | Hill | 100/14 |
| 3,446,446 | 5/1969 | De Bruin | 100/27 |
| 3,633,492 | 1/1972 | Gilvar | 100/12 |
| 3,678,845 | 7/1972 | Francois | 100/12 |

FOREIGN PATENT DOCUMENTS

| | | | |
|---|---|---|---|
| 2607711 | 10/1976 | Fed. Rep. of Germany | 100/12 |
| 560793 | 6/1977 | U.S.S.R. | 100/27 |

*Primary Examiner*—Billy J. Wilhite
*Attorney, Agent, or Firm*—Michael J. Striker

[57] ABSTRACT

A machine for tying a coil of wire with ties comprises a substantially flat support having at least one cutout, wherein the coil and the flat support are movable with respect to each other to place a portion of the coil into the cutout. A clamp is provided in the region between the closed end of the cutout and the adjacent end face of the coil for gripping one end of the tie at a fixed point. A tie guide rotatably mounted on the flat support defines a path about the cutout and carries an element for gripping a point of the tie adjacent the fixed point so that during rotation of the tie guide the tie is wound about the portion of the coil in the cutout. A cutter arranged in the region between the closed end of the cutout and the end face of the coil serves to cut the tie after being wound about the portion of the coil, whereafter the ends of the tie are twisted by twisting elements.

18 Claims, 9 Drawing Figures

20
27
23
25
4
1
2
26
22
20
24
43
44
46
45
44
43
8
5

VIII
VIII
20
22
24
26
27
27a
28
29
33
34
35
36
36a
36c
36d
38
39
40
41
42
X
X'
Y
Y'
Y-Y'
A
C
D
O
F1
1

MACHINE FOR TYING COILS OF METAL WIRE

BACKGROUND OF THE INVENTION

This invention concerns a machine for tying coils of metal wire which are produced in particular in metallurgical plants.

Tying devices are known in which clamps can be displaced parallel to the axis of the coil on the outside and inside thereof so as to form a loop around the coil with a tie wire, the two ends of this loop being then twisted.

Machines are also known which effect this tying by laying two ties parallel to each other, one on the outside of the coil and the other on the inside, and then twisting these ties at the two ends of the coil.

Other known machines have guide tubes, in which the tie is pushed in the direction towards a twisting head.

These machines have a number of drawbacks—the time for tying the tie is generally rather long and therefore poorly compatible with the rate of production of the coils to be tied.

The propelling of the tie wire in guide tubes results in a cold-working of this wire which may cause the breaking of the wire at the time of the tying. It is possible to use an annealed wire in order to avoid this drawback, but the cost of the tying would then be much too high.

Furthermore, guide tubes are subject to extensive wear and the systems for opening them in order to release the tie wire and tighten it around the coil are complicated and expensive. Moreover, the mechanical strength of the tyings obtained and the appearance of the twists are relatively unsatisfactory. The excessively protruding ends of the ties which are not bent over may, in fact result, in injuries and complicate the handling of the tied coils.

In the applicant's French Pat. No. 2,186,000 a device is described for the tying of coils of wires which comprises tying arms provided with clamps for grasping the end of the tie, said arms being mounted for rotation around a shaft supported by a carriage.

This carriage is movable in translation parallel to the axis of the coil and means are provided to pass one arm on the outside of the coil and the other arm on the inside of this coil.

This arrangement makes it possible to have the tie pass over the inner face and over the outer face of the wall of the coil.

These tying arms are satisfactory in most cases. However, these arms may be damaged when the coil is irregular (as is frequently the case) or poorly positioned with respect to these tying arms or when this coil contains wires which protrude into the inner cylindrical space of the coil.

In French Pat. No. 2,186,000 a machine has also been described which makes it possible to twist the ends of ties laid around the wall of the coil. The twisting means of this machine comprise a translatable and rotatable mandrel having a head which is adapted to receive the two ends of the tie, as well as a back-up plate arranged facing the head of the mandrel in order to hold the tie during the rotation of the mandrel.

This twisting device makes it possible to fasten the tie between the mandrel and the back-up plate, the latter remaining stationary during the twisting.

Due to the presence of this back-up plate this twisting device does not make it possible to obtain a very effective clamping of the ties against the wall of the coil.

SUMMARY OF THE INVENTION

The object of the present invention is to overcome the drawbacks of the known devices by creating a machine of relatively simple construction which makes it possible to tie wire coils in a rapid and reliable manner.

In accordance with the invention, this machine, which comprises means for laying ties around the coil and means for twisting the free ends of these ties, is characterized by the fact that is comprises a substantially flat support having a cutout, a tie guide defining a path extending partly around said cutout, means for displacing the support towards the coil in order to engage the wall of said coil in the said cutout of the support, means for holding one end of the tie fast at a point indicated between the end of the cutout in the support and the adjacent end of the wall of the coil, by the fact that the tie guide comprises means for gripping the tie at a point located in the vicinity of the said fixed point and means for driving this grasped point of the tie along the closed path of the tie guide, and by the fact that means are provided to cut this tie at a point located between the wall of the coil and the said grasped point of the tie.

The wall of the coil being engaged in the cutout in the support, the tie is driven by the tie guide along the path, which extends all around the wall of the coil. At the end of the path, the grasped point of the tie returns to its initial position in such a manner that this tie forms a loop around the wall of the coil. It is then merely necessary to cut this tie downstream of the point where it is grasped by the tie guide and then to twist the two free ends of the tie against the adjacent end of the wall of the coil.

The said support and its tie guide do not run the risk of being damaged upon the translation of the cutout in said support relative to the wall of the coil.

Experience has furthermore shown that the machine of the invention makes it possible to obtain a particularly rapid and dependable tying.

In accordance with one preferred embodiment of the invention, the tie guide defines a circular path around the wall of the coil. Such a circular path can be produced by simple means.

In accordance with one advantageous embodiment of the invention, the means for gripping and pulling the tie along the said circular path comprise a ring mounted for rotation around an axis perpendicular to the support, said ring, having an opening which is located opposite the entrance to the cutout when said ring is in position of rest and said ring bearing at least one roller for the gripping of the tie. The opening in said ring permits the engagement of the wall of the coil in the cutout in the support.

This ring preferably bears a plurality of rollers which make it possible to guide the tie upstream of the point where it is grasped by the ring, along the circular path determined by the ring.

The machine in accordance with the invention preferably comprises means for the driving in rotation of the coil engaged in the cutout in the support.

Thus after the applying of a first tie it is sufficient to subject the coil to successive angular rotations in order to be able to apply other ties, without having to change the position of the support with respect to the coil.

In one advantageous embodiment of the invention, the machine comprises two substantially flat supports each having a tie guide, these supports being arranged substanially in a diametral plane of the coil. Thus it is possible simultaneously to place two ties around the wall of the coil, in diametrically opposite regions of the coil.

The machine in accordance with the invention also has means for cutting the ends of the tie and for twisting these ends against the wall of the coil.

The means for cutting the tie are preferably borne by a rotary mandrel whose twisting end has a diametral groove adapted to receive the ends of the tie.

This diametral groove serves for twisting these ends of the wire.

The twisting means preferably comprise, inter alia, two plates arranged on opposite sides of the axis of the mandrel and movable towards said axis in a plane located between the twisting end od the mandrel and the wall of the coil, said plane passing substantially through the point of intersection of the ends of the tie.

Upon the twisting these plates make it possible to apply the ends of the tie strongly against the wall of the coil so as to obtain in this way a very compact tie and to center the intersection of the ties properly in the axis of the twisting head.

The machine for the tying of metal coils advantageously comprises, in combination, means for compacting the coil before the tying of it.

These compacting means comprise two presser plates which are movable axially towards the coil.

In accordance with the invention, these two presser plates comprise means for advancing them towards the opposite ends of the coil at identical speeds and symmetrically with respect to said coil.

Experience has shown that this arrangement makes it possible to obtain perfect uniformity of the compacting, contrary to the known compacting apparatus having a fixed plate and a movable plate.

The perfect uniformity of the compacting which is obtained contributes considerably to the durability of the ties placed around the coils.

Other features and advantages of the invention will become evident from the following description.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

In the embodiment shown in the accompanying drawings, the machine of the invention is a compactertyer, that is to say it comprises, in combination, means for compacting wire coils and means for placing ties around these coils.

The means for compacting the wire coils will first of all be described since the compacting operation takes place before the tying of these coils.

Figure 1:
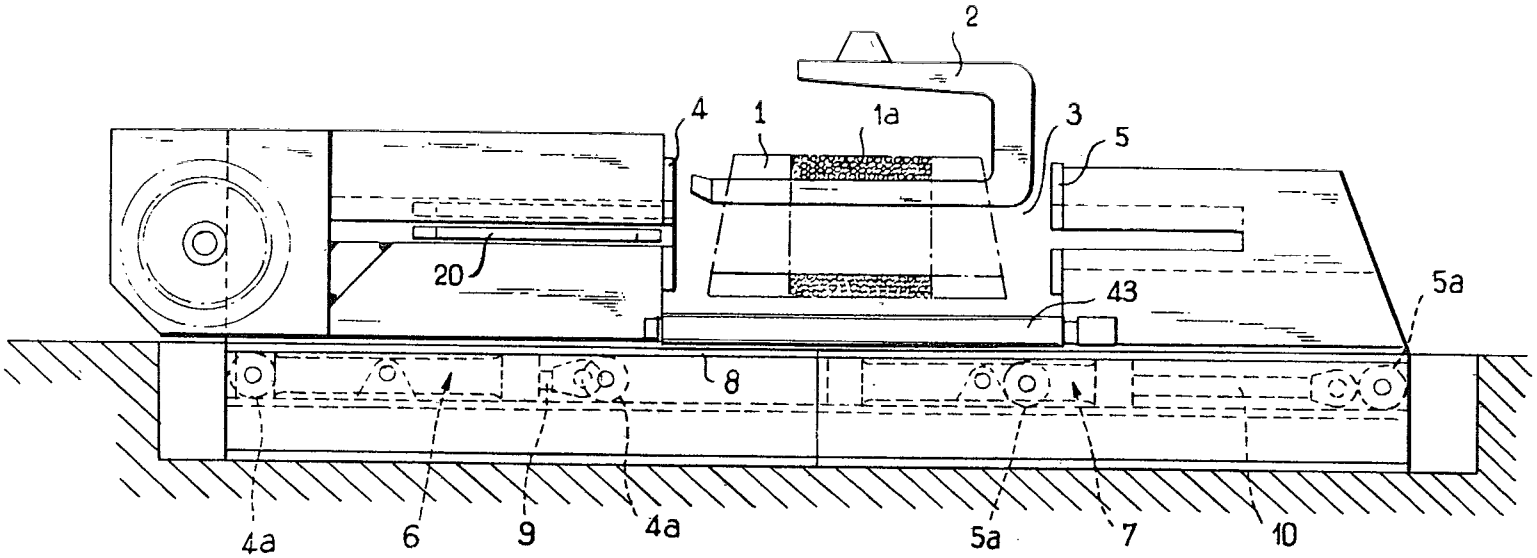
FIG. 1 is an elevation of a machine in accordance with the invention, a wire coil being shown in this machine.

Referring to FIG. 1, the coil 1 of wire, for instance steel wire, is brought, carried by the hook 2 of a conveyor (not shown), within the space 3 between two vertical presser plates 4 and 5 mounted on carriages which can move in translation by means of rollers 4*a* and 5*a*.

Before compacting, the coil 1 has a trapezoidal longitudinal section (non-hatched portion of the coil shown in FIG. 1) due to the fact that the turns of this coil are relatively loose.

In accordance with the invention, the presser plates 4 and 5 are associated with means which make it possible to advance them at identical speeds and symmetrically with respect to the coil 1.

In the example shown, these means comprise two identical hydraulic jacks 6 and 7 fastened to the frame 8 of the machine. The rods 9 and 10 of these jacks 6 and 7 are secured to the presser plates 4 and 5, respectively.

Figure 2:
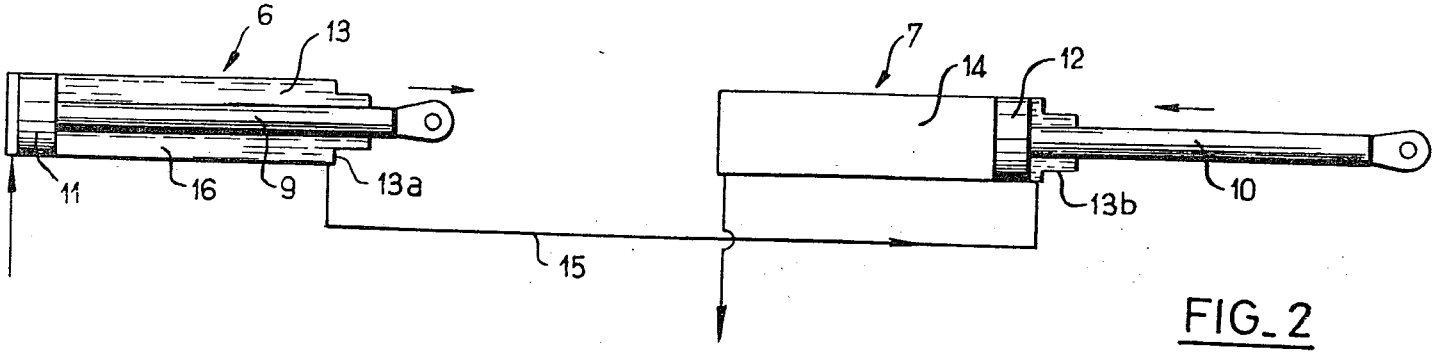
FIG. 2 is a diagrammatic view in partial longitudinal section through two jacks for the driving of the presser plates of the machine in accordance with the invention.

The pistons 11 and 12 (see FIG. 2) are staggered longitudinally with respect to their respective chambers 13, 14 in such a manner that when the rod 9 or 10 of one of the jacks 6 or 7 is in retracted position the rod 9 or 10 of the other jack is in extended position. The ends 13*a* and 13*b* of the chambers 13 and 14 of the jacks 6 and 7 which are located on the same side as the rods 9 and 10 of the pistons 11 and 12 communicate with each other by means of a pipe 15. Thus, the displacement of the pistons 11 and 12 takes place in opposite direction to each other by volumetric transfer of the hydraulic fluid 16 contained in one of the chambers 13 and 14 of the jacks 6 and 7 towards the other chamber 13 or 14 of these jacks.

As a result of this, the speeds of displacement towards the coil 1 of the presser plates 4 and 5 are absolutely identical. If one designates by v the speed of displacement of the rods 9 and 10 of the jacks 6 and 7 it is found that the speed of displacement of the presser plates 4 and 5, referred to the coil 1, is equal in total amount to 2v. This speed is therefore doubled as compared with the previous embodiments having a fixed presser plate and a plate which is movable under the action of a single hydraulic jack.

The compacter in accordance with the invention thus makes it possible substantially to increase the rate of production of the compacted coils, without consuming additional energy.

Furthermore, the fact that the presser plates 4 and 5 are advanced at identical speeds and symmetrically with respect to the coil 1 solves the problem of the centering of the coils 1 with respect to the presser plates 4 and 5. This coil-centering operation constituted a considerable loss of time in the known compacters.

The compacter in accordance with the invention also makes it possible to obtain perfect uniformity of the compacting of the coils 1, which is of a nature to considerably facilitate the subsequent tying operations.

The compacter of the invention also has the advantage that it permits the compacting of the coil 1 without the necessity to remove the coil 1 from the hook 2. As a matter of fact, upon this compacting, this hook 2 can engage in recesses 4*b* and 5*b* (FIG. 3) behind the presser plates 4 and 5.

The machine of the invention comprises furthermore means for compacting the coil 1 in two different successive compression steps separated by a step of decompression of the coil 1.

In the most common cases the coils are compacted under a pressure corresponding to a thrust of 30 to 50 tons exerted by the presser plates 4 and 5, whereupon these coils 1 are decompressed to obtain an extension of their length by about 10%. The coils 1 are then again compacted to the aforementioned compacting pressure.

There is thus obtained the surprising result that this second compacting operation makes it possible to reduce the length of the coils by 5 to 15% compared with the length resulting from a single compacting step. The compacting of the coils is thus substantially improved.

This result can be explained by the fact that during the decompression step, the turns of the coil find a favorable position of equilibrium, then making it possible to improve the compacting rate.

This completely compacted coil is shown in FIG. 1 by the hatched portion 1*a*.

The means for placing ties on a coil 1 which has been compacted in this way will now be described.

In FIGS. 3 to 8 these means for placing ties around the coil 1 comprise first of all a flat support 20 which is movable in translation relative to the coil 1. In inactive position this flat support 20 is housed behind the presser plate 4, as indicated in FIG. 1.

The translation of this flat support 20 towards the coil 1 and towards the presser plate 5 is controlled by a hydraulic jack 21 fastened to the frame 8 of the machine. In the example shown, this flat support 20 is displaceable in a horizontal plane passing substantially through the axis of the coil 1.

The flat support 20 has two identical tie guides 22, 23 which define circular paths.

These tie guides 22, 23 extend around two substantially rectangular cutouts 24, 25, parallel to each other, to the axis of the coil 1 and to the direction of displacement of the flat support 20.

When the flat support 20 is in operating position as indicated in FIGS. 3 to 8, the wall 26 of the coil is completely engaged in the cutout 24 and 25 of this flat support 20. Therefore, the tie guides 22 and 23 encircle the wall 26 of this coil 1 over major portions thereof along two diametrically opposite sections of this coil.

Figures 5, 6:
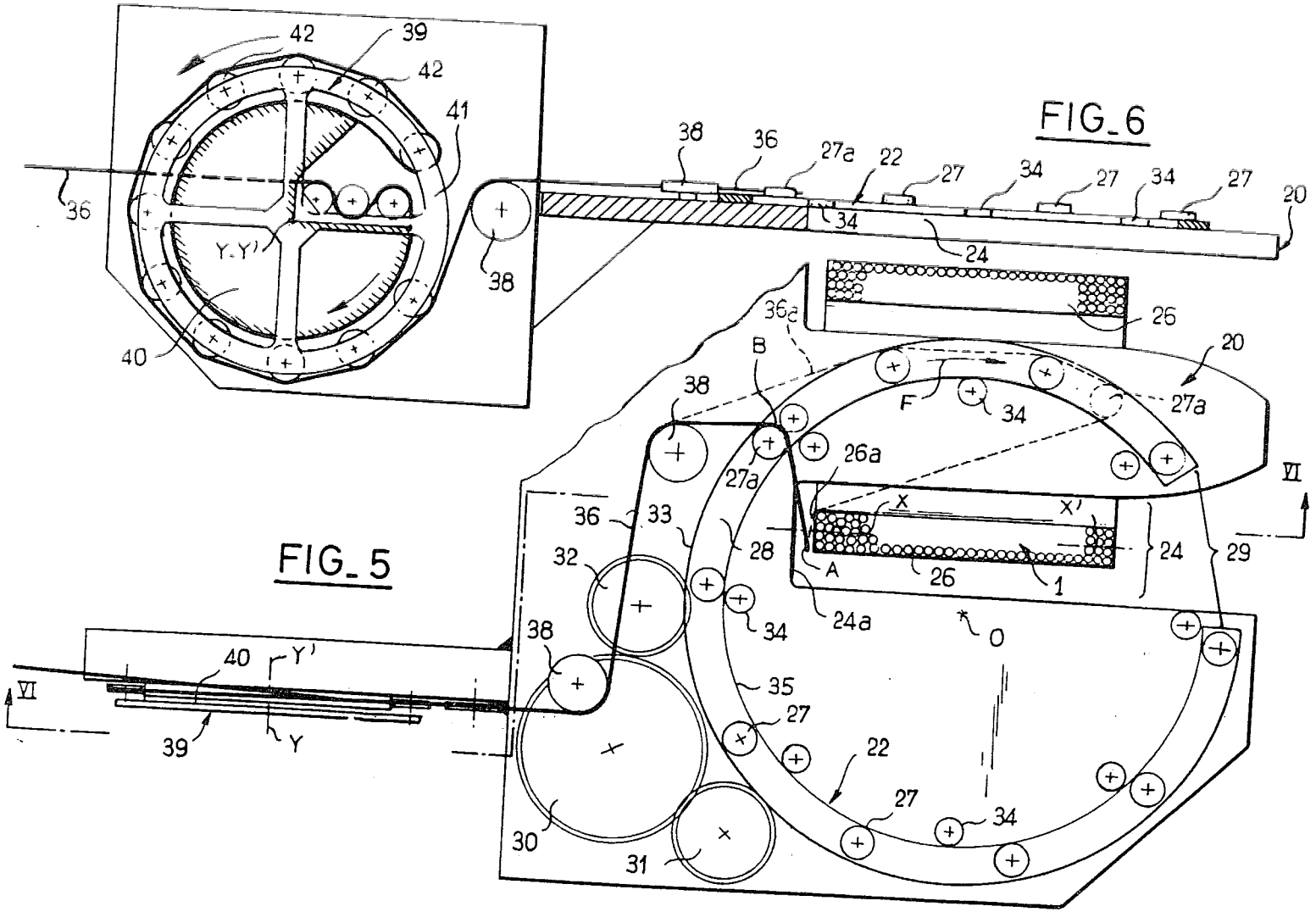
FIG. 5 is a fragmentary top view on a large scale of a tie-guide support and the tensioner, the support being in operating position, before the applying of a tie.
FIG. 6 is a section along the plane VI—VI of FIG. 5.
Figures 7, 8:
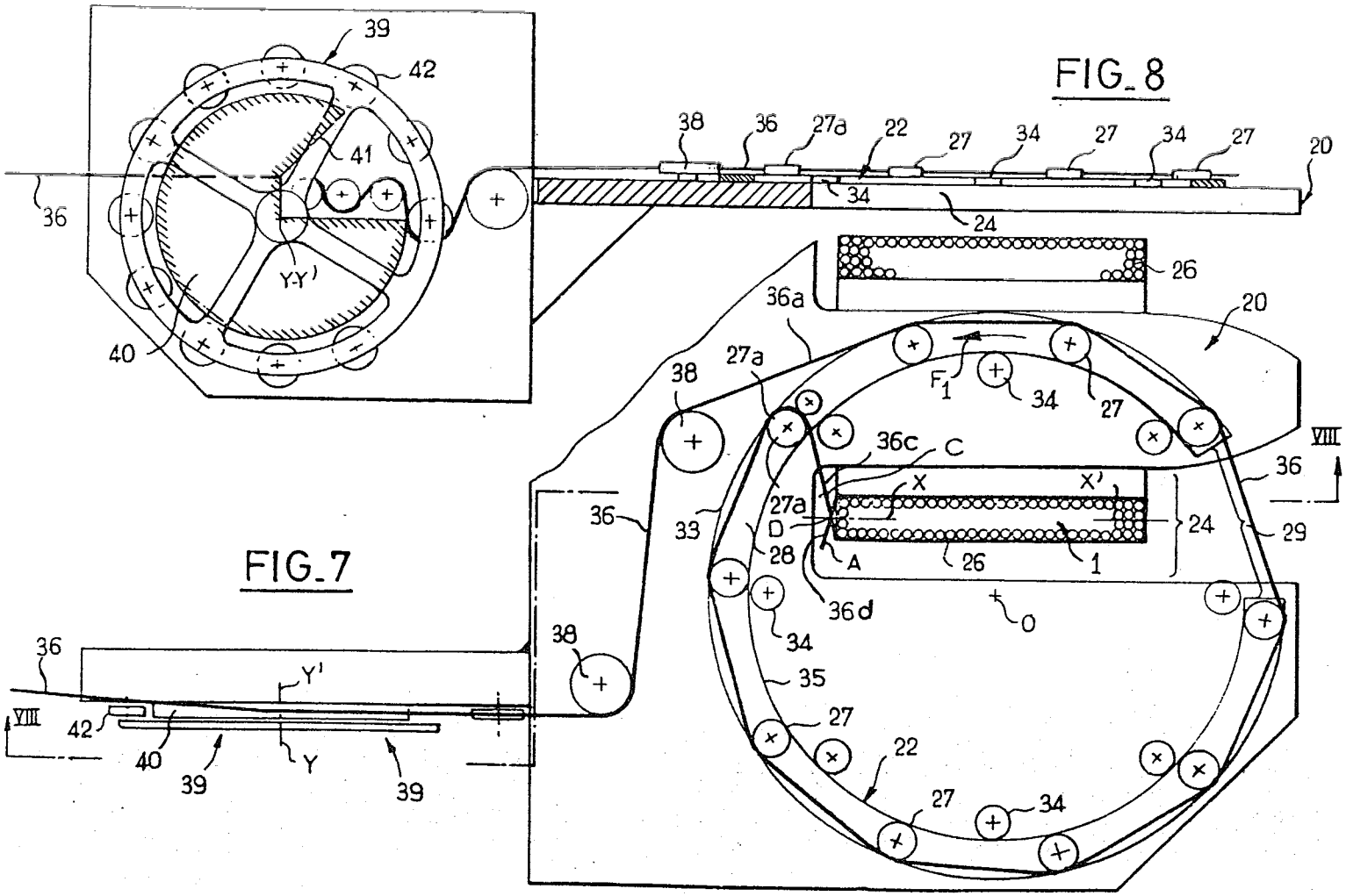
FIG. 7 is a view similar to FIG. 5, after the applying of a tie.
FIG. 8 is a sectional view along the plane VIII—VIII of FIG. 7.

The detailed structure of the tie guides 22 and 23 is shown in detail in FIGS. 5 and 7.

In FIGS. 5 and 7 it is seen that each tie guide 22 or 23 comprises a series of rollers 27 which are uniformly distributed around the circular path defined by the tie guide 22 or 23. These rollers 27 are fixed on a split ring 28, the split defining an opening 29 which is located opposite the inlet of the cutout 24 of the support 20 when the tie guide 22 is in inactive position. This split ring 28 is relatively thin and it rests on the support 20.

Pinions 30, 31, 32 mesh with each other and with the periphery 33 of the ring 28, making it possible to drive the latter in rotation around its axis 0.

The centering of the ring 28 on this axis 0 is assured by means of rollers 34 which press against the inner edge 35 of this ring 28.

The machine furthermore comprises means for holding the tie 36 fast at a point A located between the end 24*a* of the cutout 24 and the adjacent end 26*a* of the wall 26 of the coil 1. For reasons which will be explained further below, this fixed point A is located behind the axis X—X′ with reference to the direction of rotation of the ring 28 (see arrow F in FIG. 5).

This fixed point A can be obtained by a clamp 37 (see FIG. 9) which holds the end A of the tie 36.

The tie guide 22 also comprises means for gripping the tie 36 at a point B located opposite the fixed point A relative to the axis X—X′. In FIG. 5 these gripping means consist of the roller 27*a*, the tie 36 being wound in part around this roller 27*a*. In the example shown, the tie 36 is stretched between the fixed point A, around the roller 27*a* and around three pulleys 38 by means of a tensioner 39.

This tensioner 39 comprises a fixed disk 40 and a wheel 41 mounted for rotation around an axis Y—Y′ centered on the disk 40. The tie 36 is wound in clockwise direction around this pulley 40 and then is wound in a loop in the opposite direction over a series of rollers 42 arranged on the periphery of the wheel 41.

The tension exerted on the tie 36 between the tensioner 39 and the fixed point A is produced by means of a spiral spring or the like (not shown) inserted between the disk 40 and the wheel 41.

Figure 3:
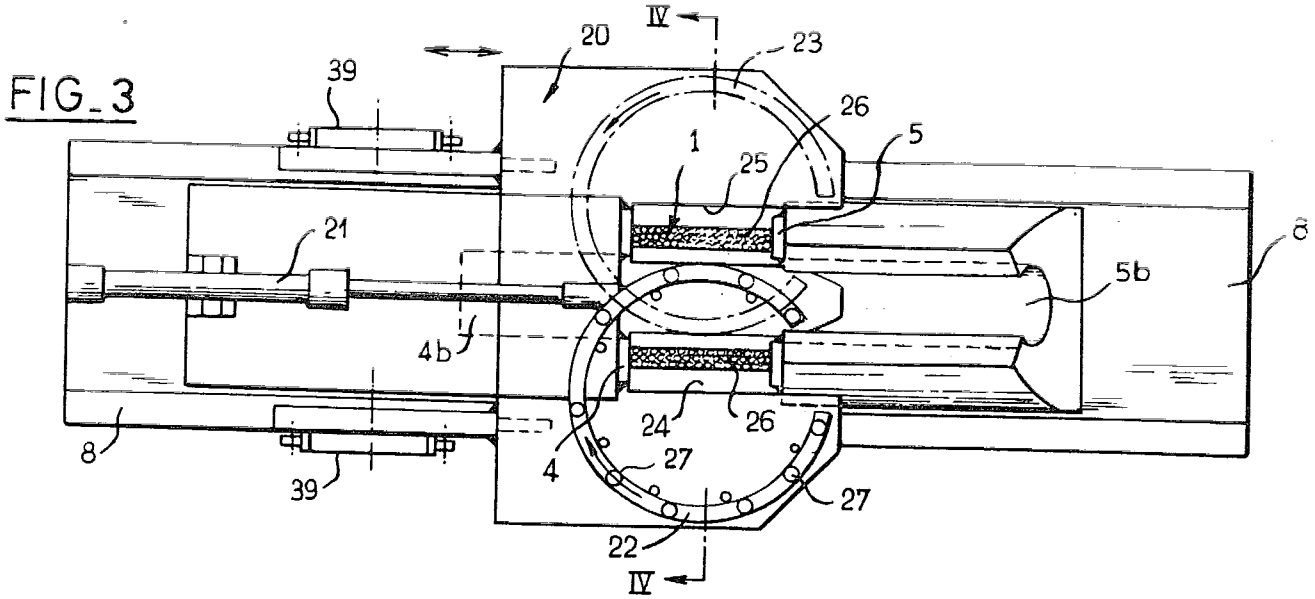
FIG. 3 is a top view of the machine shown in FIG. 1, the support containing the tie guides being in operating position and the coil-handling hook being removed for the clarity of the drawing.
Figure 4:
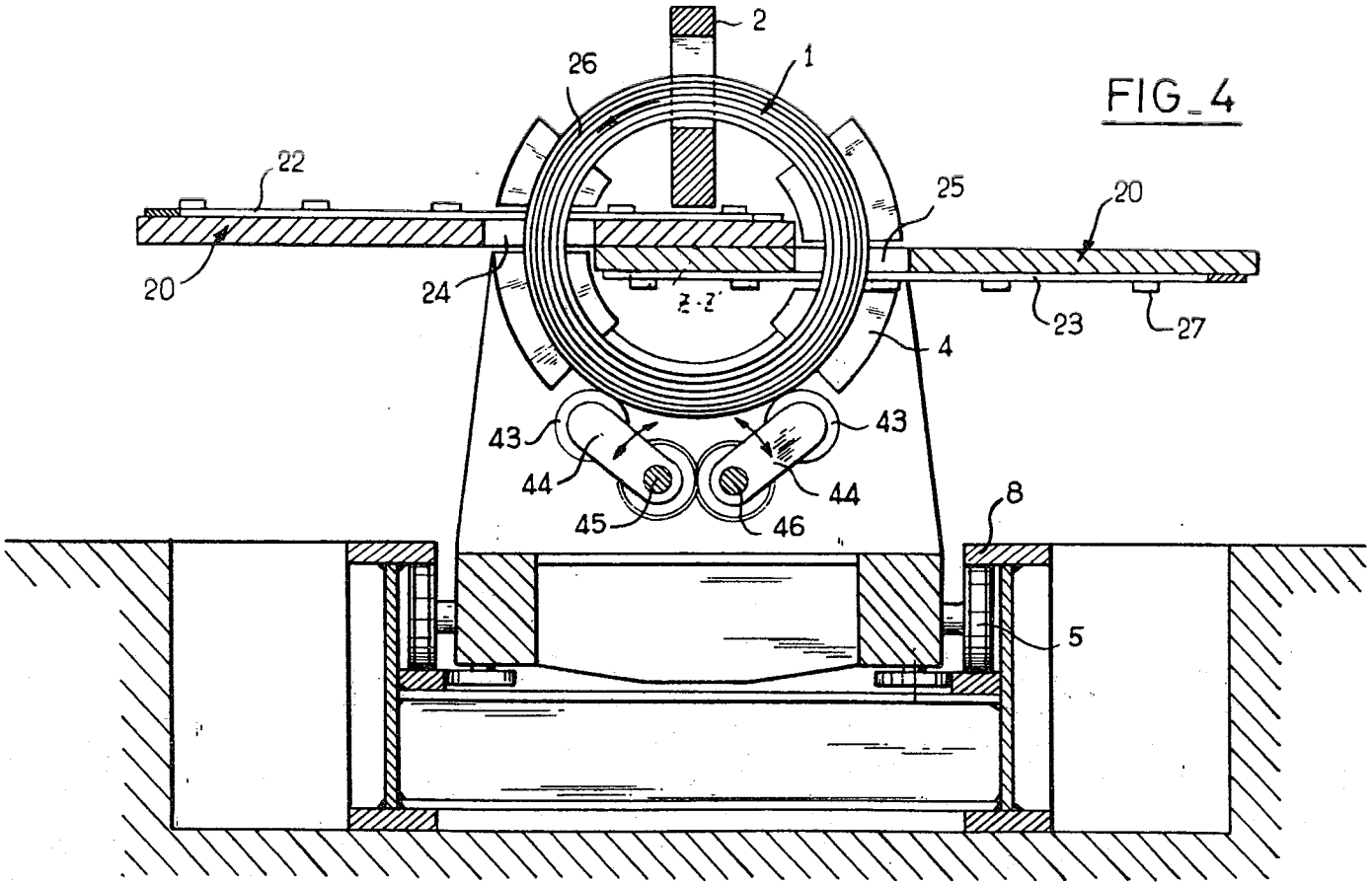
FIG. 4 is a section along the plane IV—IV of FIG. 3.

In FIGS. 3 and 4 it is seen that the support 20 has two cutouts 24 and 25 and two juxtaposed tie guides 22 and 23 making it possible simultaneously to place two ties 36 around the wall 26 of the coil 1. As indicated in FIG. 4, the tie guides 22 and 23 are located in planes which are slightly shifted with respect to the axis Z—Z′ so as to permit a partial superimposing of the tie guides 22 and 23 and therefore a reduction in the size and width of the support 20.

It is furthermore noted from FIG. 4 that the coil 1 rests on rollers 43 which may be driven in rotation by a system of pulleys or pinions and an electric motor (not shown). This arrangement makes it possible to cause the coil 1 to turn on itself in accordance with predetermined angular rotations so as to be able to place several pairs of ties 36 around the wall 26 of the coil 1 without shifting the support 20.

The rollers 43 are supported by arms 44 pivotally mounted on pins 45, 46 so as to make it possible properly to adjust the position of the coil 1 with respect to the cutouts 24 and 25 of the support 20.

The operation of the tying machine which has just been described will now be explained.

After the compacting of the coil 1, the position of the latter in the space 3 is adjusted by means of the pivoting arms 44 bearing the rollers 43, the hook 2 remaining engaged in the coil 1.

The support 20 is then displaced towards the coil 1 in such a manner that the wall 26 of said coil is completely engaged in the cutouts 24 and 25 of the support 20.

The tie 36 is placed around the pulleys 38 and then around the roller 27*a* of the ring 28, whereupon the end of the tie is fixed at A by means of the clamp 37.

The ring 28 is caused to effect a complete revolution around its center 0 in the direction indicated by the arrow F (see FIG. 5).

The tie 36 which is gripped by the roller 27*a*, is thus pulled around the wall 26 of the coil 1 (see intermediate dashed-line position of the tie 36 in FIG. 5).

The portion 36*a* of the tie 36 which is between the gripping roller 27*a* and the pulley 38 winds around the rollers 27 preceding the roller 27*a*. These rollers 27 thus guide the tie 36 along the circular path defined by the ring 28.

In FIG. 7, the roller 27*a* has described a complete rotation around the center 0 and the tie 36 has described a complete loop around the wall 26 of the coil 1. This loop is tightened as a result of the tension applied by the tensioner 39. The portion 36*c* of the tie 36 included between the coil 1 and the position of the roller 27*a* intersects the end of the tie fixed at the point A.

It is then sufficient to cut this portion 36*a* of the tie 36 at a point C symmetrical to the fixed point A with respect to the point of intersection D of the two terminal portions 36*c* and 36*d* of the tie 36.

After cutting the tie 36 at the point C, the free end of the tie 36 is held by means of a clamp similar to the clamp 37. The ring 28 is then caused to effect a rotation in opposite direction (see arrow F1) which returns it to its initial position, such as shown in FIG. 5. This rotation in opposite direction is facilitated by the tension exerted on the tie 36 by means of the tensioner 39. This rotation has the effect of winding the tie 36 around the wheel 41 of this tensioner 39. The placing of a new tie 36 around the coil 1 is effected in the manner described previously, after displacement of the aforementioned clamp towards the fixed point A.

Figure 9:
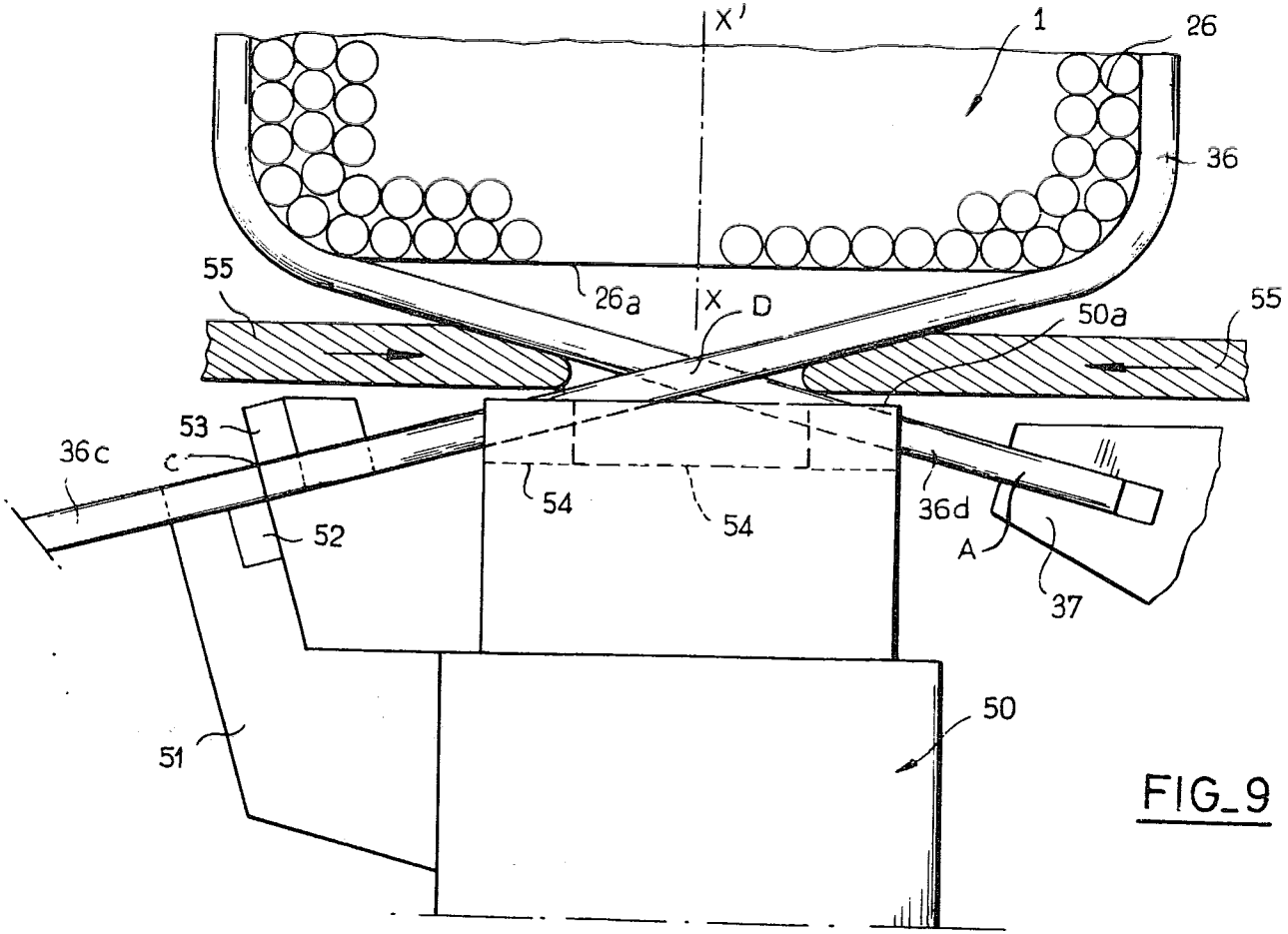
FIG. 9 is a plan view on a large scale of the device for the cutting and twisting of the ends of the tie placed around the coil.

These cutting and twisting operations are carried out by means of a rotary mandrel 50 shown in FIG. 9.

This mandrel 50 is aligned substantially in the axis X—X' of the section of the wall 26 of the coil 1 which is surrounded by the tie 36 and with the point of intersection D of the ends 36*c* and 36*d* of the tie 36.

This rotary mandrel bears laterally an arm 51 comprising a knife 52 which can come into contact with the portion 36*c* of the tie 36 upon the rotation of this mandrel 50. A fixed knife 53 serves as abutment for the portion 36*c* of the tie 36 when the knife 52 rests against the said portion.

In order to twist the free portions 36*c* and 36*d* of the tie 36 together, the mandrel 50 is provided on its end 50*a* adjacent to the end 26*a* of the wall 26 of the coil with one or more diametric grooves 54 which can receive said ends 36*c* and 36*d* of the tie 36 when the mandrel 50 is moved towards the point of intersection D of these ends 36*c* and 36*d* of the tie 36.

The twisting device comprises furthermore two plates 55 arranged on opposite sides of the axis of rotation X—X' of the mandrel 50 and movable towards said axis in a plane located between the head 50*a* of the mandrel 50 and the wall 26 of the coil 1. This plane furthermore passes through the point of intersection D of the ends 36*c* and 36*d* of the tie 36.

In order to twist the free ends 36*c* and 36*d* of the tie 36 surrounding the wall 26 of the coil 1, one proceeds in the following manner:

The mandrel 50 is advanced in the direction towards the axis X—X' towards the point of intersection D of the ends 36*c* and 36*d* of the tie 36. The plates 55 are moved towards the point of intersection D which has the effect on the one hand of engaging the ends 36*c* and 36*d* of the strand 36 in one of the dimetral grooves of the mandrel 50 and on the other hand of placing these ends against the adjacent end 26*a* of the wall 26. The twisting proper can then be effected by turning the mandrel 50 around the axis X—X'.

Of course, the different sequences of operation of the machine, namely the correct positioning of the coil 1 by means of the pivoting arms 44 bearing the rollers 43, the translation of the support 20 by means of the jack 21, the rotation of the rings 28 of the tie guides 22 and 23, the displacement of the clamp 37 towards the fixed point A, and the successive rotations of the coil 1 can be controlled in a fully automatic manner by known means.

The advantages of the tying machine in accordance with the invention are numerous.

First of all the tie guides 22 and 23 do not run the risk of being damaged upon the relative engagement of the wall 26 of the coil 1 and the cutouts 24 and 25 in the support 20 even when certain turns of the coil 1 protrude into the cylindrical space within said coil.

Furthermore, the proper adjustment of the relative position of the coil 1 with respect to the support 20 does not raise any difficulty and is simple to carry out due to the drive rollers 43 borne by the pivoting arms 44.

Furthermore, the cutting and twisting device 50 which comprises the cutting arm 51 and the movable plates 55, makes it possible to effect tight twistings which are securely applied against the wall 26 of the coil 1. The ties thus produced do not therefore run the risk of becoming loose which might cause considerable difficulties upon the transportation of the coils 1.

Of course, the invention is not limited to the examples which have just been described and numerous changes may be made therein without going beyond the scope of the invention.

It will be understood that each of the elements described above, or two or more together, may also find a useful application in other types of machines for tying coils of wire differing from the types described above.

While the invention has been illustrated and described as embodied in a machine for tying coils of metal wire, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

I claim:

1. A machine for tying coils of wire by at least one tie, comprising a substantially flat support having at least one elongated cutout having an open and a closed end; a tie guide defining a path around said cutout; means for displacing said support and said coil relative to each other to place a portion of said coil into said cutout with an end face of said coil adjacent said closed end of said cutout; means for fixing one end of a tie at a point located between said closed end of said cutout and the adjacent end face of the coil; means on said tie guide for gripping the tie at a point adjacent said fixed point; means for driving said gripped point along said path defined by said tie guide to thereby wind the tie about the portion of the coil; means for cutting the tie at a point located between the end face of the coil and the gripped point; and means for twisting the one end of the tie with the cut end.

2. A machine as defined in claim 1, wherein said tie guide defines a circular path around said cutout.

3. A machine as defined in claim 2, wherein said means for driving said gripped point along said circular path comprises a split ring mounted for rotation about an axis normal to said flat support, said split ring having an opening opposite said open end of said cutout, when said ring is in a rest position, and said means for gripping the tie comprises a roller on said ring.

4. A machine as defined in claim 3, wherein said ring carries a plurality of additional rollers circumferentially displaced from each other for guiding said tie upstream of the gripped point.

5. A machine as defined in claim 1 and including means for supporting said coil and rotating the same about its axis with a portion of said coil located in said cutout.

6. A machine as defined in claim 1, wherein said machine comprises two substantially flat supports, each having a cutout and a tie guide, said supports being arranged substantially in a diametrical plane of said coil.

7. A machine as defined in claim 6, wherein said two supports overlap at portions between said cutouts.

8. A machine as defined in claim 5, wherein said means for supporting and rotating the coil comprises a pair of transversely spaced rotary rollers on which the coil rests.

9. A machine as defined in claim 8, and means for changing the spacing between said rotary rollers to regulate the position of the coil with respect to said flat support.

10. A machine as defined in claim 9, wherein said means for changing the spacing comprises a pair of arms each pivotally mounted at one end and carrying a respective one of said rotary rollers on the other end thereof.

11. A machine as defined in claim 1, wherein the fixed one end of said tie and the end of the tie cut by said cutting means are located symmetrically with respect to a plane of symmetry of said cutout.

12. A machine as defined in claim 1, and including means for tensioning the tie upstream of the point gripped by said gripping means.

13. A machine as defined in claim 1, wherein said means for cutting the tie comprises a mandrel having an axis and being turnable about said axis, a first cutting knife carried by said turnable mandrel laterally of the axis of the latter and a stationary cutting knife arranged for cooperation with said first cutting knife.

14. A machine as defined in claim 13, wherein said means for twisting the one end and the cut end of the tie comprises a diametrical groove in an end face of said mandrel directed towards the end face of the coil.

15. A machine as defined in claim 14, wherein said twisting means further comprise two plates arranged on opposite sides of the axis of said mandrel and movable towards said axis in a plane between the end face of said coil and the end face of said mandrel.

16. A machine as defined in claim 1 and including means for compacting the coil before the tying thereof, said compacting means comprises a pair of opposite presser plates between which the coil is arranged and means for axially moving the presser plates with identical speeds toward each other.

17. A machine as defined in claim 16, wherein said means for moving said presser plate comprise two identical hydraulic jacks having each a stationary cylinder, a piston movable in the respective cylinder and a piston rod connected to the piston for movement therewith and projecting with an end thereof connected to the respective presser plate beyond one end of the respective cylinder and each movable with the respective piston between a retracted and an extended position, said one end of the cylinder of one of said jacks faces in the same direction as said one end of the cylinder of the other of said jacks and the pistons are staggered so that when one of the piston rods is in said retracted position the other of said piston rods is in said extended position; a conduit providing communication between the interior of said cylinders at the one ends thereof so as to permit displacement of the pistons of said two jacks by transfer of hydraulic pressure fluid from one of the jacks to the other jack, and means for feeding respectively discharging pressure fluid into and out from the other end of each jack.

18. A machine as defined in claim 17, and including means for compacting the coil in two stages of succession compression separated by a stage of decompression of the coil.

* * * * *

UNITED STATES PATENT AND TRADEMARK OFFICE

CERTIFICATE OF CORRECTION

PATENT NO. : 4 301 720

DATED : November 24,1981

INVENTOR(S) : Hubert Elineau

It is certified that error appears in the above—identified patent and that said Letters Patent is hereby corrected as shown below:

On the title page:

[30] The priority data should read

-- Feb.22,1979 France 79 04535 --

Signed and Sealed this

*Eighteenth* Day of *June 1985*

[SEAL]

*Attest:*

DONALD J. QUIGG

*Attesting Officer* *Acting Commissioner of Patents and Trademarks*